US006048226A

United States Patent [19]

Iwahori

[11] Patent Number: 6,048,226

[45] Date of Patent: Apr. 11, 2000

[54] FRONT HOLDER-INCORPORATING CONNECTOR

[75] Inventor: Yoshihiro Iwahori, Shizuoka, Japan

[73] Assignee: Yazaki Corporation, Tokyo, Japan

[21] Appl. No.: 09/149,295

[22] Filed: Sep. 9, 1998

[30] Foreign Application Priority Data

Sep. 9, 1997 [JP] Japan ..... 9-244310

[51] Int. Cl.[7] ..... H01R 13/40

[52] U.S. Cl. ..... 439/595; 439/751

[58] Field of Search ..... 439/752, 595

[56] References Cited

U.S. PATENT DOCUMENTS

| | | | |
|---|---|---|---|
| 5,151,052 | 9/1992 | McCardell | 439/752 |
| 5,658,168 | 8/1997 | Myer et al. | 439/595 |
| 5,722,857 | 3/1998 | Saito et al. | 439/595 |
| 5,730,626 | 3/1998 | Tomita et al. | 439/595 |
| 5,842,884 | 12/1998 | Maegawa et al. | 439/595 |

FOREIGN PATENT DOCUMENTS

| | | | |
|---|---|---|---|
| 2-86078 | 3/1990 | Japan | H01R 13/64 |

*Primary Examiner*—Renee S. Luebke
*Assistant Examiner*—T. C. Patel
*Attorney, Agent, or Firm*—Sughrue, Mion, Zinn, Macpeak & Seas, PLLC

[57] ABSTRACT

A front holder-incorporating connector includes terminal receiving chambers formed in a connector housing, terminals each having a contact portion, which is formed at a front end thereof, and projects in a connector fitting direction, elastic retaining piece portions respectively elastically retaining the terminals received respectively in the terminal receiving chambers, and a front holder attached to a fitting-side front end surface of the connector housing so as to prevent the flexing of the elastic retaining piece portions, thereby preventing the elastic retaining piece portions from being brought out of retaining engagement with the terminals. Support surfaces are formed on the front holder, and are abutted respectively against the contact portions in a direction perpendicular to the direction of projecting of the contact portions, thereby supporting the contact portions, respectively.

5 Claims, 5 Drawing Sheets

FRONT HOLDER-INCORPORATING CONNECTOR

BACKGROUND OF THE INVENTION

1. Field of the Invention

This invention relates to a front holder-incorporating connector having a front holder which prevents elastic retaining piece portions (which retain terminals on a housing) from being brought out of retaining engagement with the terminals.

The present application is based on Japanese Patent Application No. Hei. 9-244310, which is incorporated herein by reference.

2. Description of the Related Art

Generally, in a connector used in the wiring in a vehicle or the like, when terminals are mounted in a housing, elastic retaining piece portions are retainingly engaged respectively with the terminals inserted respectively into terminal receiving chambers in the housing. One example of such a connector is a front holder-incorporating connector in which a member (front holder) for preventing the flexing (elastic deformation) of the elastic retaining piece portions, retainingly engaged respectively with the terminals, is mounted on the housing, thereby retaining the terminals against withdrawal in a double manner.

For example, in a male-type front holder-incorporating connector in which male terminals are mounted in such a manner that contact portions (male tabs), formed respectively at front ends of these terminals, project in a connector fitting direction, and tab insertion holes, through which the male tabs project from the housing, are formed in a front (fitting side) end surface of the housing. Terminal receiving chambers for respectively receiving the male terminals are formed in the housing, and these terminal receiving chambers communicate respectively with the tab insertion holes. An elastic retaining piece portion is formed within each of the terminal receiving chambers, and is integrally connected at its proximal end to the housing, and its free distal end portion is movable into and out of the housing. More specifically, during the insertion of the male terminal into the terminal receiving chamber, the male terminal is brought into sliding contact with the elastic retaining piece portion, so that the elastic retaining piece portion is once flexed into a retraction space formed adjacent to the terminal receiving chamber, and after the male terminal is completely inserted into the terminal receiving chamber, the elastic retaining piece portion is elastically restored into the terminal receiving chamber to be retainingly engaged with a retaining portion of the male terminal, thereby retaining the male terminal in the terminal receiving chamber against withdrawal.

The above retraction spaces are open to the front end surface of the housing. A front holder can be removably attached to the front end surface of the housing. The front holder has projecting leg portions which can be inserted respectively into the retraction spaces.

In such a front holder-incorporating connector, the male terminals are mounted respectively in the terminal receiving chambers, and then the front holder is attached to the front end surface of the housing. As a result, the leg portions of the front holder are inserted respectively into the retraction spaces, thereby preventing the elastic retaining piece portions from moving into the respective retraction spaces, and therefore each of the elastic retaining piece portions is prevented from being brought out of retaining engagement with the associated male terminal, thus preventing the withdrawal of each terminal in a double manner.

In the above conventional front holder-incorporating connector, generally, the male tabs 7, projecting respectively through the tab insertion holes 5 formed in the front end surface 3 of the housing 1, respectively contact abutment surfaces 5*a* of the tab insertion holes 5 only at their upper surfaces, as shown in FIG. 8. Particularly where the width of the elastic retaining piece portion 9 is equal to the width of the male tab 7, it is difficult to provide upper and lower abutment surfaces of the tab insertion hole, which can contact the male tab 7, because of a mold-releasing operation effected when the housing is molded. On the other hand, in the conventional front holder-incorporating connector, an inner peripheral surface of each male tab insertion hole in the front holder 11 is kept out of contact with the male tab 7. Therefore, when the front holder 11 is attached to the housing, the male tab 7 contacts the abutment surface 5*a* only at its upper surface, and therefore is liable to move upward and downward, and for example, when a mating connector 13 is inserted into this connector, with the male tabs 7 inclined downwardly as shown in FIG. 8, the distal ends of the male tabs 7 are not aligned with insertion guide recesses 15 in the mating connector 13, and strike against a front end surface of the mating connector 13, which results in a possibility that the male tabs 7 are deformed or damaged.

As shown in FIG. 9, in the case where terminal receiving chambers 17 are arranged in a plurality of rows in a vertical direction, and leg portions 21 to be inserted respectively into retraction spaces 19 are provided in a vertically-asymmetrical manner, a front holder 11 can not be easily inserted in a parallel manner when attaching this front holder to the connector, and an angular moment in a direction of arrow a develops on that side of the front holder facing away from the leg portions 21, which invites a problem that the efficiency of the holder-attaching operation is much lowered. In contrast, if the front holder is formed into a vertically-symmetrical design only for this reason, the efficiency of the holder-attaching operation can be enhanced, but the front holder and the housing are increased in size.

SUMMARY OF THE INVENTION

The present invention has been made in view of the above problems, and an object of the invention is to provide a front holder-incorporating connector in which the movement of male tabs is prevented, and the direction of insertion of a front holder is limited, thereby preventing the deformation of terminals when fitting the connector, and also enhancing the efficiency of a front holder-attaching operation.

To achieve the above object, according to the aspect of the present invention, there is provided a connector which comprises: a connector housing; a terminal receiving chamber formed in the connector housing; a terminal insertable into the terminal receiving chamber, the terminal having a contact portion formed at a front end thereof, the contact portion which projects in a connector fitting direction when the terminal is inserted into the terminal receiving chamber; an elastic retaining piece portion retaining the terminal, the elastic retaining piece portion preventing the terminal from being disengaged from the terminal receiving chamber; a front holder attachable to a fitting-side front end surface of the connector housing, the front holder preventing flexing of the elastic retaining piece portion, and preventing the elastic retaining piece portion from being brought out of engagement with the terminal; and a support surface formed on the front holder, the support surface abutting against the contact portion in a direction perpendicular to a projecting direction of the contact portion of the terminal. In the connector, the support surface is formed on the front holder, and the contact portion is supported by the support surface, thereby preventing the contact portion from moving. During the insertion of the front holder, the support surface moves in sliding contact with the contact portion, and the direction of movement of the front holder is limited to a parallel direction.

Preferably, the above connector may further comprise a projection formed on a front end surface of the front holder which faces in a mating connector-fitting direction, and a part of an outer peripheral surface of the projection extending from the support surface. In the connector, the support area for the contact portion can be increased.

Preferably, the above connector may further comprise: a mating connector housing fittable to the connector housing; a terminal insertion hole, into which the contact portion of the terminal is insertable, formed in a front end surface of the mating connector housing; and an insertion guide recess formed around a peripheral edge of the terminal insertion hole, wherein the projection has such a configuration as to be fitted in the insertion guide recess. In the connector, the projection prevents the two connectors completely fitted together from being displaced relative to each other in a direction perpendicular to the fitting direction.

Preferably, the connector may further comprise an abutment surface formed on the connector housing, the abutment surface being opposed to the support surface, wherein the contact portion is held between the abutment surface and the support surface. In this type of connector, the contact portion is retained more firmly.

DETAILED DESCRIPTION OF THE PREFERRED EMBODIMENT

Figure 1:
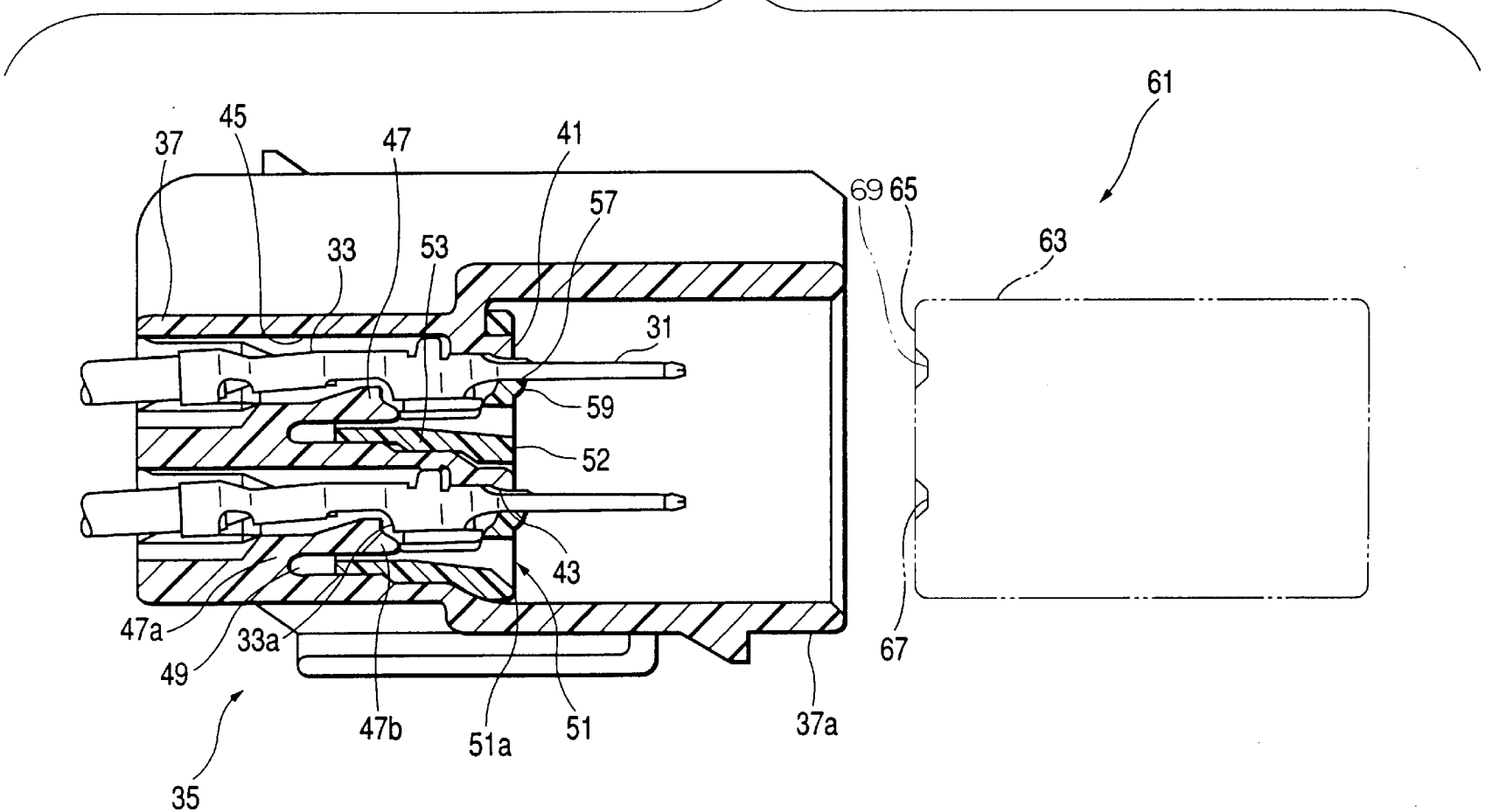
FIG. 1 is a cross-sectional view of a front holder-incorporating connector of the present invention.
Figure 2:
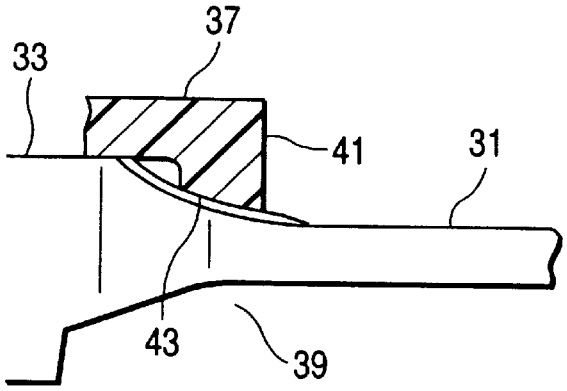
FIG. 2 is an enlarged view of an important portion showing a condition of contact between a housing of the front holder-incorporating connector and a contact portion.

A preferred embodiment of a front holder-incorporating connector of the present invention will now be described in detail with reference to FIGS. 1 to 7.

In the male-type front holder-incorporating connector 35 in which male terminals 33 are mounted in such a manner that the contact portions (male tabs) 31, formed respectively at front ends of these terminals, project in a connector fitting direction, tab-projecting holes 39 (see FIG. 2), through which the male tabs 31 project from the housing 37, are formed in a front (fitting side) end surface 41 of the housing 37. An abutment surface 43 is formed on an inner peripheral surface of the tab-projecting hole 39, and this abutment surface 43 contacts (or abuts against) the male tab 31 in a direction perpendicular to the direction of projecting of the male tab 31.

Terminal receiving chambers 45 for respectively receiving the male terminals 33 are formed in the housing 37, and these terminal receiving chambers communicate respectively with the tab-projecting holes 39. An elastic retaining piece portion 47 is formed within each of the terminal receiving chambers 45, and is integrally connected at its proximal end 47*a* to the housing 37, and its free distal end portion 47*b* projects toward the front end surface 41 of the housing 37. The free distal end portion of the elastic retaining piece portion 47 is movable into and out of the housing 37. More specifically, during the insertion of the male terminal 33 into the terminal receiving chamber 45, the male terminal 33 is brought into sliding contact with the elastic retaining piece portion 47, so that the elastic retaining piece portion 47 is once flexed into a retraction space 49 formed adjacent to the terminal receiving chamber 45 (see FIG. 6), and after the male terminal 33 is completely inserted into the terminal receiving chamber 45, the elastic retaining piece portion is elastically restored into the terminal receiving chamber 45 to be retainingly engaged with a retaining portion 33*a* of the male terminal 33, thereby retaining the male terminal 33 in the terminal receiving chamber 45 against withdrawal.

The retraction spaces 49 are open to the front end surface 41 of the housing 37. A front holder 51 can be removably attached to the front end surface 41 of the housing 37. The front holder 51 has projecting leg portions 53 which can be inserted respectively into the retraction spaces 49. In the front holder-incorporating connector 35, the male terminals 33 are mounted respectively in the terminal receiving chambers 45, and then the front holder 51 is attached to the front end surface 41 of the housing 37. As a result, the leg portions 53 of the front holder 51 are inserted respectively into the retraction spaces 49, thereby preventing the elastic retaining piece portions 47 from moving into the respective retraction spaces 49, and therefore each of the elastic retaining piece portions 47 is prevented from being brought out of retaining engagement with the associated retaining portion 33*a* , thus preventing the withdrawal of each male terminal 33 in a double manner.

Figure 3:
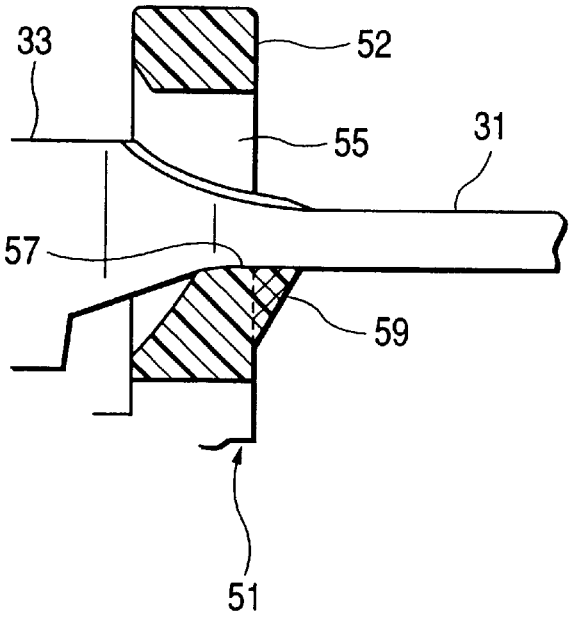
FIG. 3 is an enlarged view of an important portion, showing a condition of contact between a front holder of the front holder-incorporating connector and the contact portion.

As shown in FIG. 3, the front holder 51 has insertion holes 55, and when the front holder 51 is attached to the housing 37, the male tabs 31 pass respectively through these insertion holes 55. A support surface 57 is formed on an inner peripheral surface of the insertion hole 55, and when the front holder 51 is inserted into a hood portion 37*a* of the housing 37, the support surface 57 contacts (or abuts against) the male tab 31 in a direction perpendicular to the projection direction of the male tab 31. When the support surfaces 57 of the front holder 51 are abutted respectively against the male tabs 31, a lower end 51*a* (see FIG. 1) of a front plate of the front holder 51 contacts an inner peripheral surface of the hood portion 37*a*. Namely, during the insertion of the front holder 51 into the hood portion, each support surface 57 can move in sliding contact with the associated male tab 31 in a parallel manner.

Figure 4:
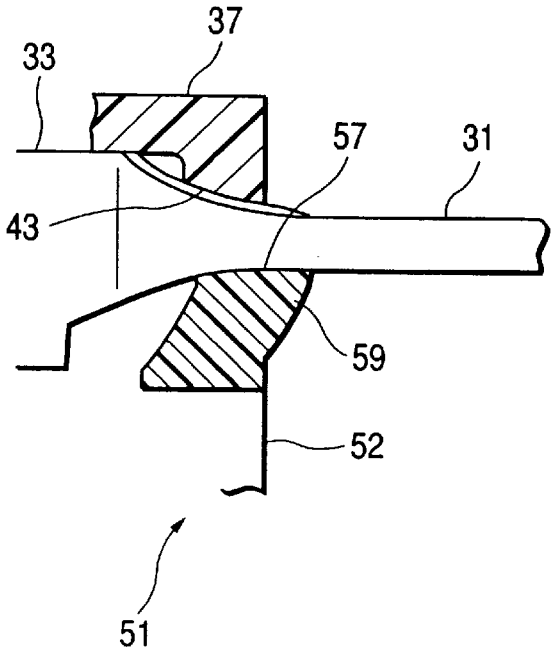
FIG. 4 is an enlarged view of an important portion, showing a condition in which the contact portion is held between the housing of the front holder-incorporating connector and the front holder.

When the front holder 51 is completely attached to the front end surface 41 of the housing 37, the support surfaces 57 are opposed respectively to the abutment surfaces 43 formed at the housing 37. Namely, when the front holder 51 is attached to the housing, the opposed abutment surface 43 and support surface 57 hold the associated male tab 31 therebetween from the upper and lower sides, as shown in FIG. 4.

Figure 5:
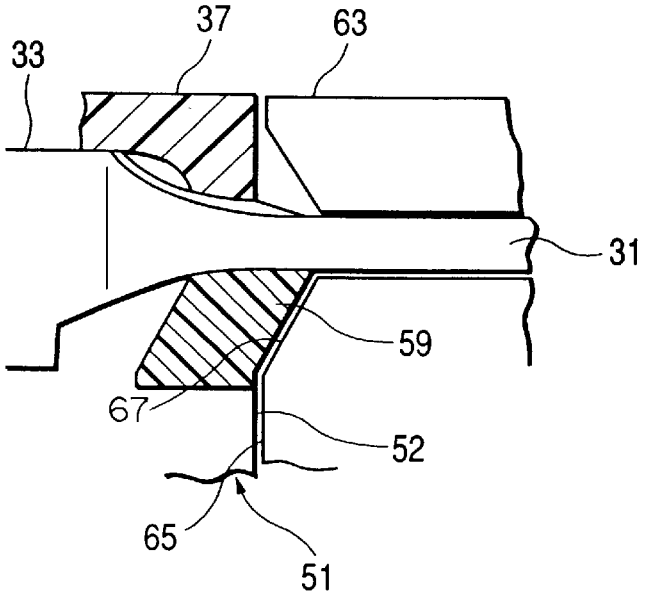
FIG. 5 is an enlarged view of an important portion, showing a condition in which the front holder-incorporating connector of FIG. 1 is fitted on a mating connector.

In the front holder-incorporating connector 35 of this embodiment, projections 59 are formed on a front end surface 52 of the front holder 51, as shown in FIG. 3. The projection 59 extends from the corresponding support surface 57. Therefore, the area of the support surface 57 is increased by the projection 59 extending therefrom. As shown in FIG. 5, the projection 59 has such a configuration as to be fitted in an associated insertion guide recess 67 formed around a peripheral edge of a terminal insertion hole 69 formed in a front end surface 65 of a housing 63 of the mating connector, the male tab 31 being adapted to be inserted into this terminal insertion hole. When the front holder-incorporating connector 35 and the mating connector 61 are fitted together, the front end surfaces 52 and 65 are abutted against each other, with the projections 59 fitted respectively in the insertion guide recesses 67.

Figure 6:
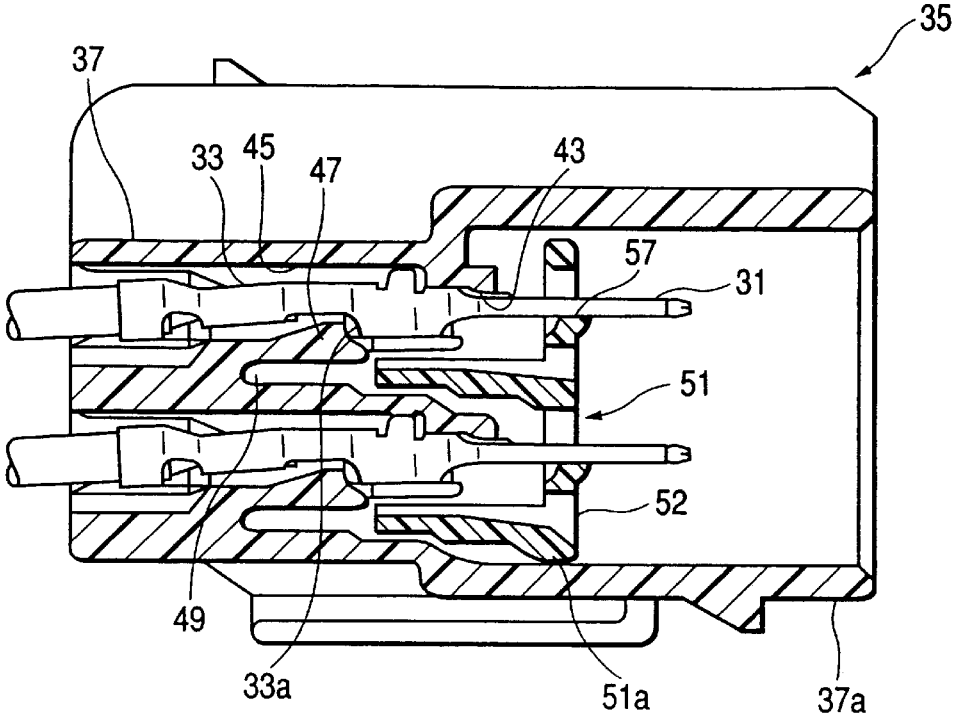
FIG. 6 is a cross-sectional view of the front holder-incorporating connector, showing a condition in which the front holder is half inserted.
Figure 7:
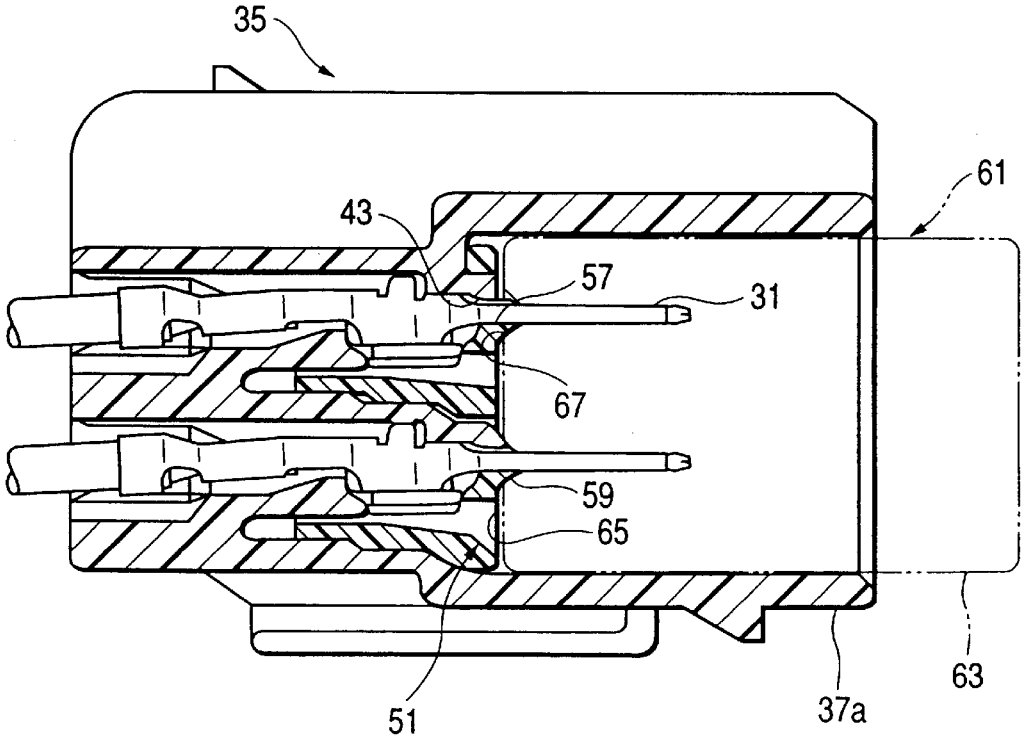
FIG. 7 is a cross-sectional view of the front holder-incorporating connector completely fitted on the mating connector.
Figure 8:
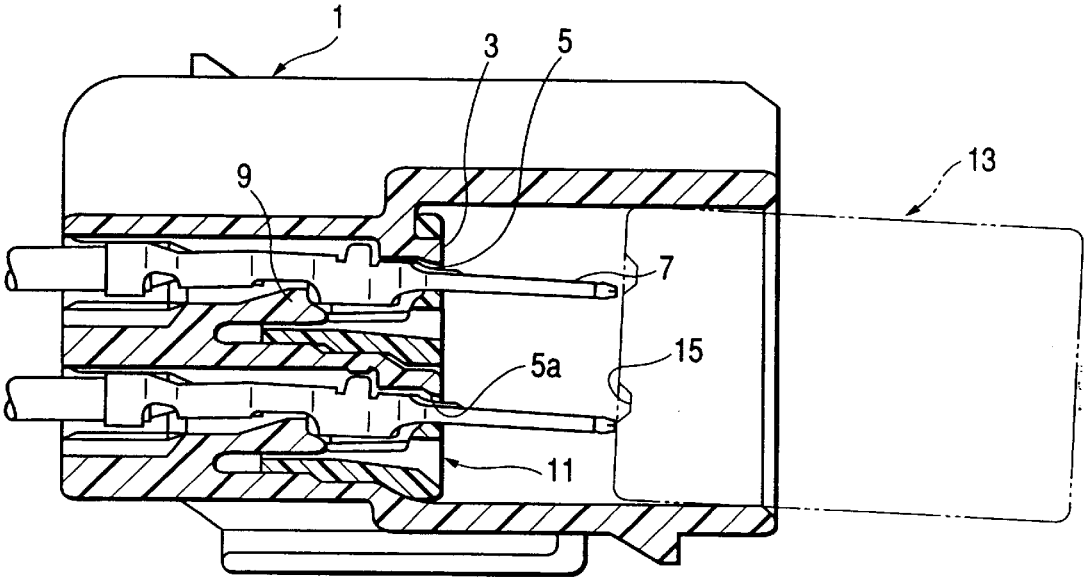
FIG. 8 PRIOR ART
FIG. 8 is a cross-sectional view of a conventional front holder-incorporating connector, showing the movement of terminals.
Figure 9:
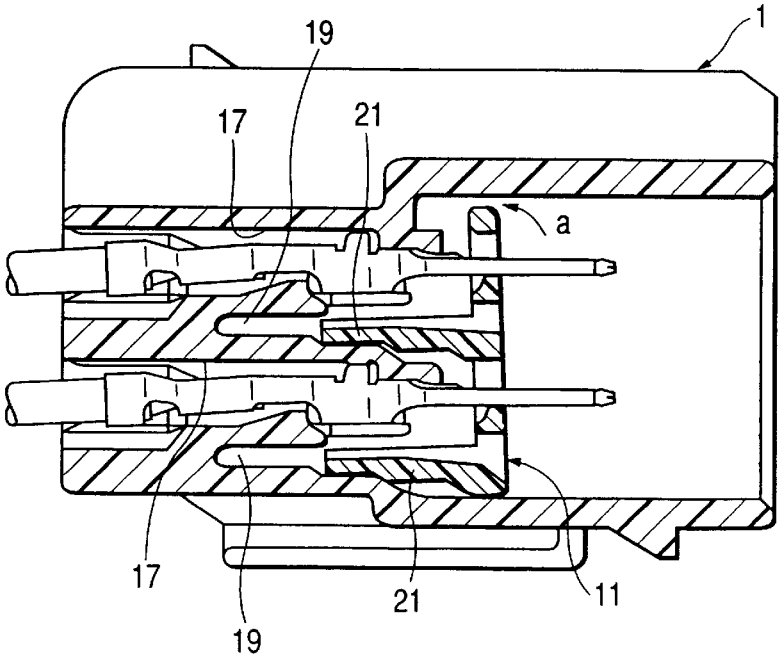
FIG. 9 PRIOR ART
FIG. 9 is a cross-sectional view of a conventional front holder-incorporating connector, showing the movement of terminals.

The operation of the front holder-incorporating connector 35 of this construction will now be described with reference to FIGS. 6 and 7. FIG. 6 is a cross-sectional view of the front holder-incorporating connector, showing a condition in which the front holder 51 is half inserted, and FIG. 7 is a cross-sectional view of the front holder completely fitted on the mating connector.

When each of the male terminals 33 is inserted into the associated terminal receiving chamber 45 from the rear side of the housing 37, the elastic retaining piece portion 47 is once flexed into the retraction space 49, and then is elastically restored into the terminal receiving chamber 45, and is retaining engaged with the retaining portion 33*a* of the male terminal 33, thereby preventing the male terminal 33 from being disengaged from the terminal receiving chamber 45. When the male terminal 33 is thus received in the terminal receiving chamber 45, the upper surface of the proximal end portion of the male tab 31 is abutted against the abutment surface 43 of the housing 37.

In this condition, when the front holder 51 is inserted into the hood portion 37*a* of the housing 37 from the front side of the housing, the lower end 51*a* of the front plate moves in sliding contact with the inner surface of the hood portion 37*a*, and also the support surfaces 57 move in sliding contact with the male tabs 31, respectively, in a parallel manner. Therefore, in contrast with the conventional construction in which the front holder is inserted in a non-contact manner, so that the direction of insertion of the front holder is not kept constant with the result that a moment develops on the front holder to thereby lower the efficiency of the inserting operation, the front holder 51 is smoothly moved in a parallel manner, and is attached to the housing 37.

When the attachment of the front holder 51 to the housing 37 is completed, the proximal end portion of each male tab 31 is held between the abutment surface 43 of the housing 37 and the support surface 57 of the front holder 51 from the upper and lower sides, so that the male tab 31 is corrected into the proper direction parallel to the fitting direction, and the male tab 31 is held against movement with a high strength. Therefore, when the mating connector 61 is inserted into the hood portion 37*a*, the distal ends of the male tabs 31 are aligned respectively with the insertion guide recesses 67 in the mating connector 61. Thus, in contrast with the conventional construction, the male tabs 31 will not be moved and inclined, and the distal ends of the male tabs 31 will not be out of alignment with the insertion guide recesses 67, and each male tab 31 will not strike against the front end surface 65 of the mating connector 61, and therefore the male tab 31 will not be deformed.

When the fitting operation is completed, the projections 59 are fitted respectively in the insertion guide recesses 67 in the mating connector 61, and therefore the projections 59 prevent the two connectors from being displaced relative to each other in a direction perpendicular to the fitting direction, thereby preventing the two connectors from moving in this direction.

As described above, in the above front holder-incorporating connector, the support surfaces 57 are formed on the front holder 51, and the male tabs 31 are supported respectively by these support surfaces 57, thereby preventing the male tabs 31 from moving, and therefore the male tabs 31 will not be moved and inclined, and will not strike against the front end surface 65 of the mating connector 61, and will not be deformed.

Because of the provision of the support surfaces 57 on the front holder 51, the support surfaces 57 move in sliding contact with the male tabs 31, respectively, during the insertion of the front holder 51, and therefore the front holder 51 can be inserted in a parallel manner, and this insertion can be effected smoothly, thereby enhancing the efficiency of the operation.

Each of the projections 59 has such a configuration as to be fitted in the associated insertion guide recess 67 in the mating connector 61, and therefore when the two connectors are completely fitted together, the projections 59 prevent the two connectors from being displaced relative to each other in a direction perpendicular to the fitting direction, thereby preventing the two connectors from being moved in this direction, thus creating an environment in which the terminals of the front holder-incorporating connector can contact terminals in the mating connector 61, respectively, in a satisfactory manner.

In the above embodiment, although the projections 59 are formed on the front end surface 52 of the front holder 51, and the projections 59 extend respectively from the support surfaces 57, the projections 59 may not necessarily be formed on the front end surface 52 in so far as the support surfaces 57 are formed on the front holder of the front holder-incorporating connector of the invention. In this case, also, the effect of preventing the deformation of the male tabs 31, as well as the effect of enhancing the efficiency of insertion of the front holder 51, can be achieved similarly.

In the front holder-incorporating connector of the invention, the abutment surfaces 43 may not be formed on the housing 37 in so far as the support surfaces 57 are formed on the front holder 51, and in this case, also, the deformation prevention effect, as well as the effect of enhancing the efficiency of insertion of the front holder 51, can be achieved in a certain degree.

As described above in detail, in the above front holder-incorporating connector of the present invention, the support surfaces 57 are formed on the front holder 51, and the contact portions 31 are supported respectively by these support surfaces 57, thereby preventing the contact portions from moving, and therefore the contact portions will not be moved and inclined, and will not strike against the front end surface of the mating connector 13, and will not be deformed. During the insertion of the front holder 51, the support surfaces 57 are moved in sliding contact with the contact portions 31, respectively, and the front holder 51 can be inserted in a parallel manner, and this insertion can be effected smoothly, thereby enhancing the efficiency of the operation.

The projections 59 are formed on the front surface of the front holder 57, and the projections extend respectively from the support surfaces. With this construction, the support area for the contact portion 31 is increased, and the contact portion can be retained more firmly.

Each of the projections 59 has such a configuration as to be fitted in the associated insertion guide recess 67 in the mating connector 61, and therefore when the two connectors are completely fitted together, the projections prevent the two connectors from being displaced relative to each other in a direction perpendicular to the fitting direction, thereby preventing the two connectors from being moved in this direction, thus creating an environment in which the terminals 33 of the front holder-incorporating connector can contact terminals in the mating connector 61, respectively, in a satisfactory manner.

The abutment surfaces 43 are formed on the connector housing 37, and the contact portion 31 is held between the abutment surface 43 and the support surface 57, and by doing so, the contact portion can be retained more firmly.

What is claimed is:

1. A connector comprising:

a connector housing;

a terminal receiving chamber formed in the connector housing;

a terminal insertable into the terminal receiving chamber, the terminal having a contact portion formed at a front end thereof, wherein the contact portion projects in a connector fitting direction when the terminal is inserted into the terminal receiving chamber;

an elastic retaining piece portion retaining the terminal, the elastic retaining piece portion preventing the terminal from being disengaged from the terminal receiving chamber;

a front holder attachable to a fitting-side front end surface of the connector housing, the front holder preventing flexing of the elastic retaining piece portion, and preventing the elastic retaining piece portion from being brought out of engagement with the terminal;

a support surface formed on the front holder, the support surface abutting against the contact portion in a direction perpendicular to a projecting direction of the contact portion of the terminal; and a projection formed on a front end surface of the front holder, said projection extending from the support surface in the projecting direction of the contact portion of the terminal.

2. The connector of claim 1, further comprising:

a mating connector housing fittable to the connector housing;

a terminal insertion hole, into which the contact portion of the terminal is insertable, formed in a front end surface of the mating connector housing; and an insertion guide recess formed around a peripheral edge of the terminal insertion hole, wherein the projection has such a configuration as to be fitted in the insertion guide recess.

3. The connector of claim 1, further comprising an abutment surface formed on the connector housing, the abutment surface being opposed to the support surface, wherein the contact portion is held between the abutment surface and the support surface.

4. The connector of claim 1, further comprising an abutment surface formed on the connector housing, the abutment surface being opposed to the support surface, wherein the contact portion is held between the abutment surface and the support surface.

5. The connector of claim 2, further comprising an abutment surface formed on the connector housing, the abutment surface being opposed to the support surface, wherein the contact portion is held between the abutment surface and the support surface.

* * * * *